US007413467B1

(12) United States Patent
Lai et al.

(10) Patent No.: US 7,413,467 B1
(45) Date of Patent: Aug. 19, 2008

(54) HDMI CONNECTOR ASSEMBLY

(75) Inventors: Ming-chun Lai, Tu-Cheng (TW); Yu Li, Tu-Cheng (TW); Teng-fang Xiong, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/806,279

(22) Filed: May 31, 2007

(51) Int. Cl.
*H01R 13/648* (2006.01)

(52) U.S. Cl. ..... 439/489; 439/92; 439/607

(58) Field of Classification Search ..... 439/489, 439/92, 607, 608–610
See application file for complete search history.

(56) References Cited

U.S. PATENT DOCUMENTS 5,775,946 A * 7/1998 Briones ..... 439/607

6,835,092 B2 * 12/2004 Wan et al. ..... 439/541.5

* cited by examiner

*Primary Examiner*—Gary F. Paumen
(74) *Attorney, Agent, or Firm*—Rosenberg, Klein & Lee

(57) ABSTRACT

An HDMI connector assembly includes a female connector and a male connector. The female connector includes a female housing which has a front and a back surface and defines first passageways and a second passageway both communicating with the front and the back surface, electrical terminals received in the first passageways, an indicate terminal received in the second passageway, and a female metallic shell. The back of the indicate terminal forms a welding portion protruding out from the back surface for connecting with an indication circuit of a printed circuit board. The front of the indicate terminal forms a contact portion being at the front of the front surface. The female metallic shell defines a space for receiving the female housing therein. At least one grounding portion protrudes from the bottom of the female metallic shell for connecting with a ground circuit of the printed circuit board.

3 Claims, 4 Drawing Sheets

HDMI CONNECTOR ASSEMBLY

BACKGROUND OF THE INVENTION

1. Field of the Invention

The present invention relates to a HDMI (High Definition Multimedia Interface) connector assembly, and more particularly to a HDMI connector assembly which can indicate an engaging status between a male connector of the HDMI connector assembly and a female connector of the HDMI connector assembly.

2. The Related Art

HDMI (High Definition Multimedia Interface) is a transmission interface developed for multimedia audio video systems including DVD players, digital TV set, etc. The HDMI can transmit high quality digital signal without D/A conversion before the signal is transmitted. Meanwhile, the HDMI can effectively reduce signal interference and attenuation.

However, the conventional HDMI connector assembly gives no indication when the male connector and the female connector are engaged, so the user don't know whether the male connector and the female connector are engaged properly. Therefore, it is necessary to provide an HDMI connector assembly which can give an indication when the two connectors mates with each other.

SUMMARY OF THE INVENTION

An object of the present invention is to provide an HDMI connector assembly including a female connector and a male connector. The male connector comprises a male housing, a male mating portion extending from the male housing, male terminals received in the male mating portion, and a male metallic shell covering the mating portion. The female connector comprises a female housing, electrical terminals, an indicate terminal, and a female metallic shell. The female housing has a front surface and a back surface, the female housing defines first passageways and a second passageway communicating with the front surface and the back surface. The second passageway is at the outside of the first passageways. A flat board projects outwardly from the front surface and is inserted into the male mating portion, the flat board defines guide channels communicating with the corresponding first passageways. The electrical terminals are received in the first passageways and the guide channels for electrically connecting with the male terminals. The indicate terminal has a fixing portion received in the second passageway. The back of the fixing portion forms a welding portion protruding out from the back surface of the female housing for connecting with an indication circuit of a printed circuit board. An elastic arm is formed at the front of the fixing portion, the front portion of the elastic arm forms a contact portion, the contact portion is at the front of the front surface. The female metallic shell defines a space for receiving the female housing therein. The front of the female metallic shell defines an interface for the male mating portion inserting. At least one grounding portion protrudes from the bottom of the female metallic shell for connecting with a ground circuit of the printed circuit board. Wherein the male metallic shell contacts with the female metallic shell, the contact portion of the indicate terminal presses against the outside of the male metallic shell, a circuit is formed between the indication circuit and the grounding circuit.

when the male connector is engaged with the female connector, a circuit is formed between the indication circuit connecting with the indication terminal and the grounding circuit connecting with the grounding portion by the male metallic shell simultaneously contacting with the female metallic shell and the indicate terminal, which can give an indication that the male connector is engaged with the female connector properly.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
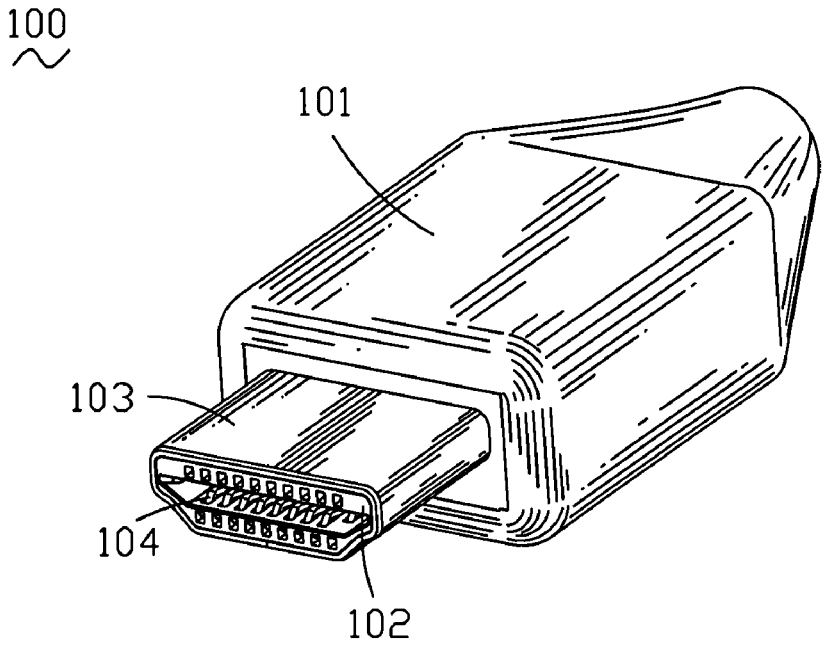
FIG. 1 is a perspective view of a male connector of a HDMI connector assembly according to the present invention.
Figure 2:
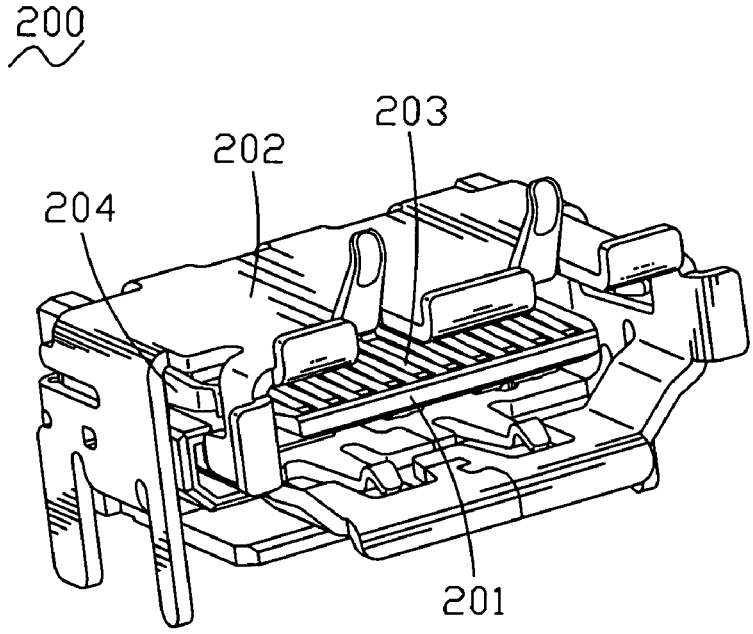
FIG. 2 is a perspective view of a female connector of the HDMI connector assembly.

With reference to FIG. 1 and FIG. 2, a HDMI connector assembly of the present invention includes a male connector 100 and a female connector 200. The male connector 100 includes a male housing 101, a male mating portion 102 extending from the male housing 101, male terminals 104 received in the male mating portion 102 and a male metallic shell 103 covering the male mating portion 102.

Figure 3:
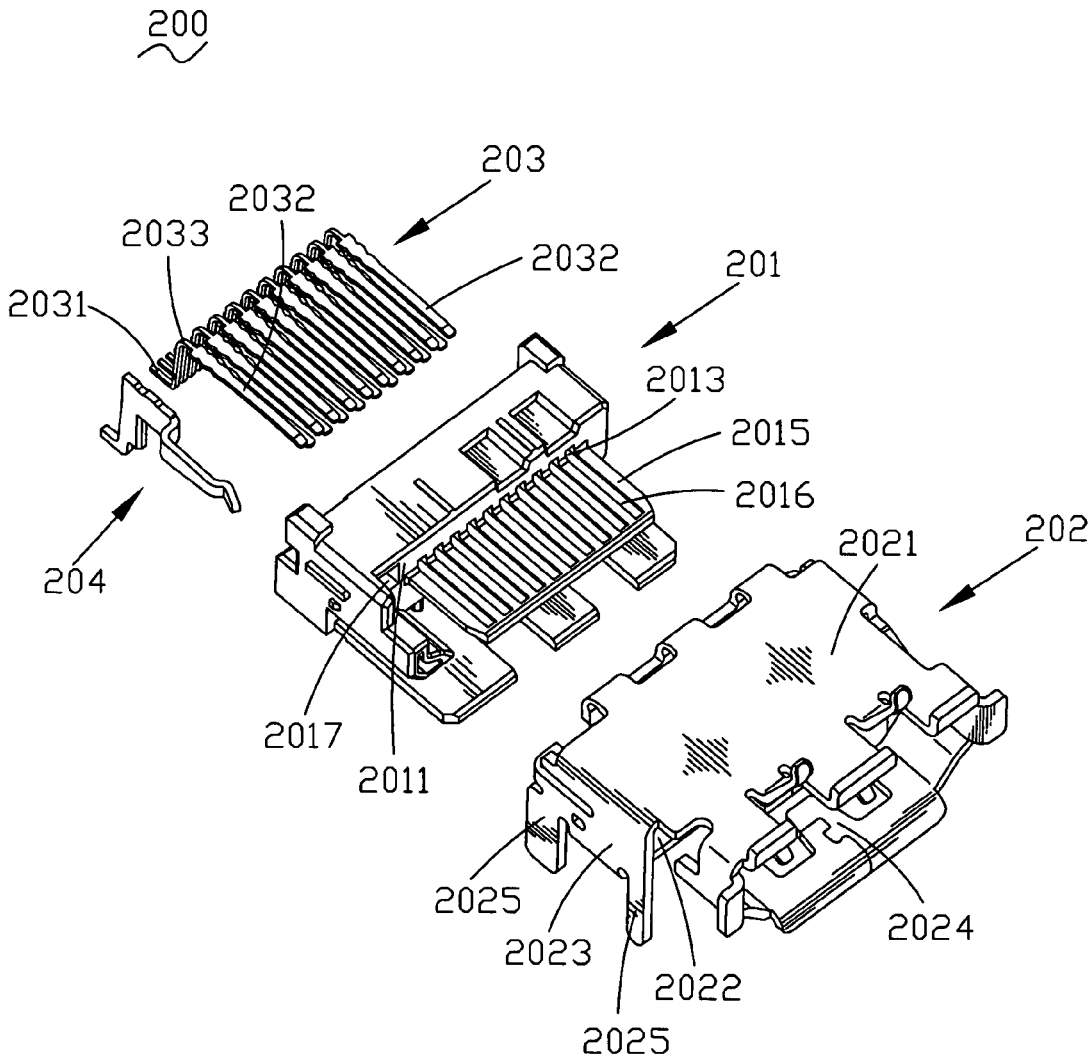
FIG. 3 is an exploded view of the female connector.
Figure 4:
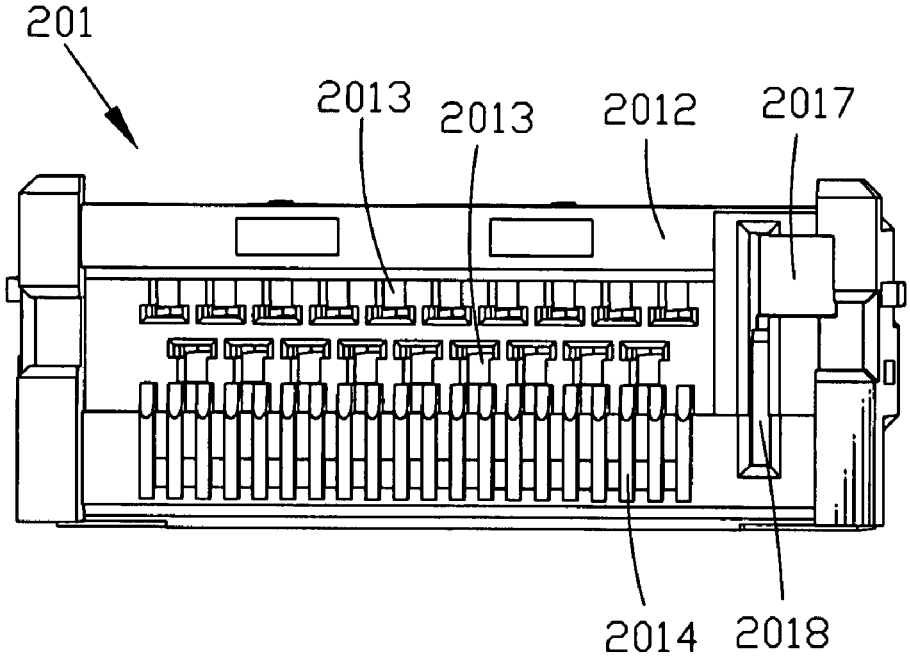
FIG. 4 is a rear view of the female housing.

Referring to FIG. 2, FIG. 3 and FIG. 4, the female connector 200 includes a female housing 201, a female metallic shell 202, a plurality of electrical terminals 203 and an indicate terminal 204. The female housing 201 is approximately in an oblong shape. The female housing 201 has a front surface 2011 and a back surface 2012. The female housing 201 defines a plurality of first passageways 2013 passing through the front surface 2011 and the back surface 2012 of the female housing 201 for receiving the electrical terminals 203, and a second passageway 2017 communicating with the front surface 2011 and the back surface 2012 of the female housing 201 for receiving the indicate terminal 204. The second passageway 2017 is at the outside of the first passageways 2013. The back portion of the first passageway 2013 defines a first positioning channel 2014 through the back surface 2012 and the back portion of the second passageway 2017 defines an second positioning channel 2018 through the back surface 2012. A flat board 2015 projects outwardly from the front surface 2011. The top of the flat board 2015 defines guide channels 2016 communicating with the corresponding first passageways 2013.

The electrical terminal 203 includes a soldering foot 2031, a contacting portion 2032 approximately paralleling with the soldering foot 2031 and a locating portion 2033 connecting the soldering foot 2031 and the contacting portion 2032 together. When the electrical terminal 203 is inserted into the first passageway 2013 from the back surface 2012 of the female housing 201, the contacting portion 2032 protrudes outwardly from the front surface 2011 of the female housing 201 and is disposed in the guide channel 2016. Meanwhile, the locating portion 2033 is located in the first positioning channel 2014, the soldering foot 2031 protrudes out from the back surface 2012 for soldering to a printed circuit board (not shown).

Figure 5:
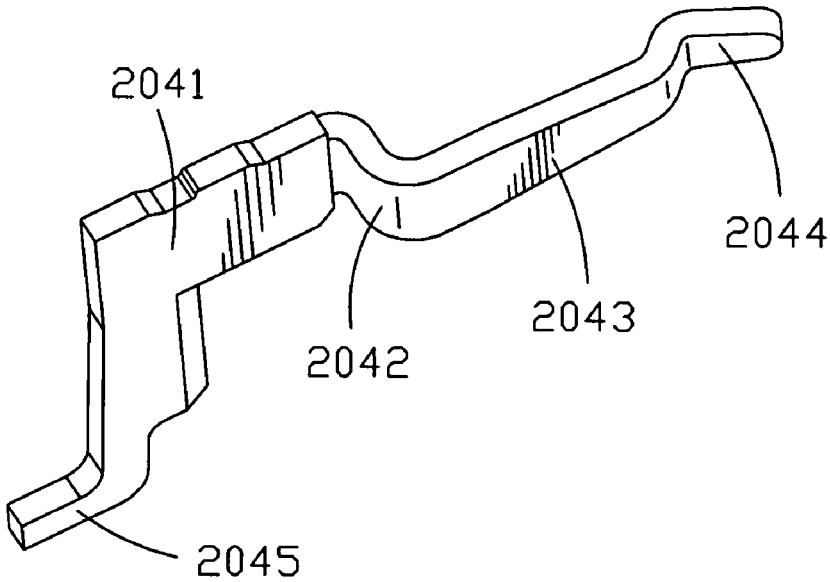
FIG. 5 is a perspective view of an indicate terminal of female connector.
Figure 6:
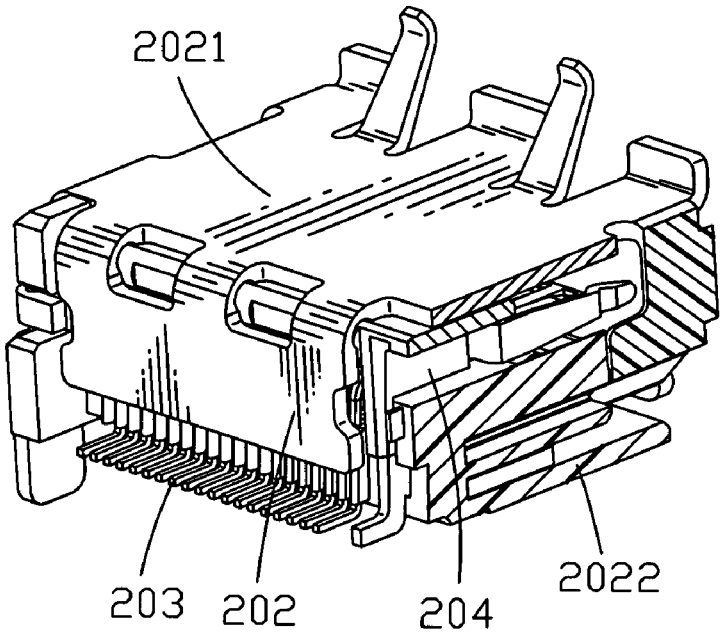
FIG. 6 is a cross-sectional view of the female connector.

Please refer to FIG. 5 and FIG. 6, the indicate terminal 204 has an L-shaped fixing portion 2041, which includes a level portion extending forward and an upright portion extending downward. The back of the upright portion of the fixing portion 2041 extends downward and then backward to form a welding portion 2045. The front end of the fixing portion 2041 extends and bends outward to form a bending portion 2042. An elastic arm 2043 extends forward from the outer end of the bending portion 2042, the front portion of the elastic arm 2043 bends inward and then outward to form a contact portion 2044. The indicate terminal 204 is inserted into the second passageway 2017 from the back surface 2012 of the female housing 201, the upright portion of the fixing portion 2041 is fixed in the second positioning channel 2018, the level portion of the fixing portion 2041 is fixed in the front of the passageway 2017, the contact portion 2044 protrudes to the outside from the front surface 2011. The welding portion 2045 protrudes out from the back surface 2012 for connecting with an indication circuit of the printed circuit board.

Referring to FIG. 3 again, the female metallic shell 202 includes a top board 2021, a bottom board 2022 and a pair of side walls 2023. The top board 2021, the bottom board 2022 and the side walls 2023 define a space therebetween. The female housing 201 is engaged in the space. The female metallic shell 202 has an interface 2024 of a traditional design in front of the space. A plurality of welding ends 2025 protrude from the bottom of the female metallic shell 202 for connecting with the printed circuit board. At least one welding end 2025 is used as a grounding portion for connecting with a ground circuit of the printed circuit board.

Figure 7:
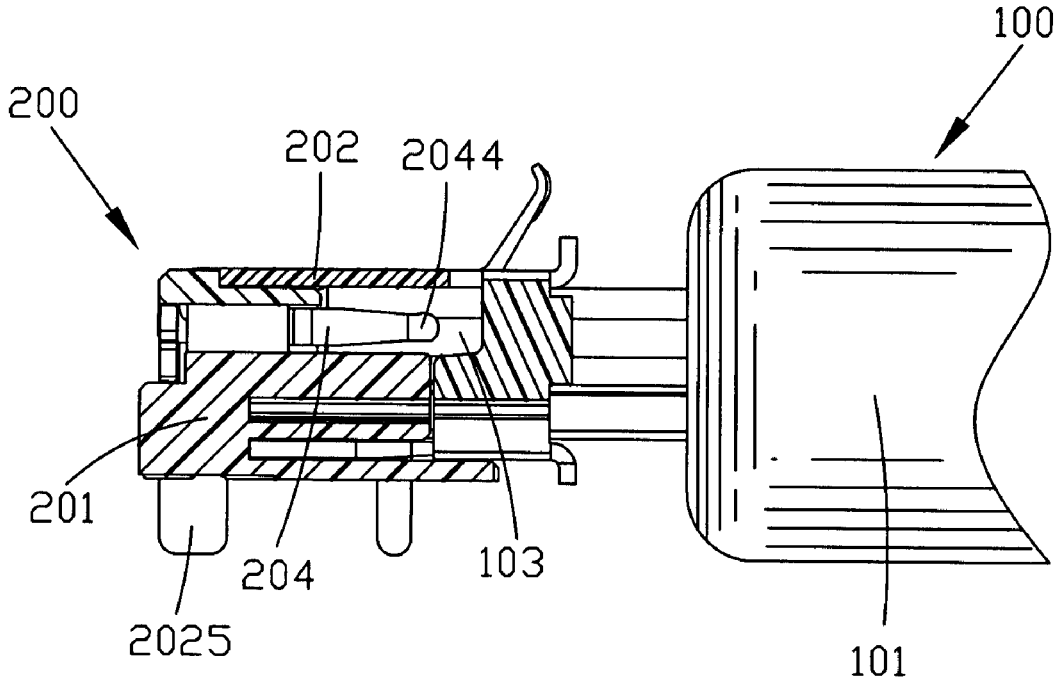
FIG. 7 is a cross-sectional view of the female connector engaged with the male connector.

Please refer to FIG. 7, when the male connector 100 connects to the female connector 200, the male mating portion 102 of the male connector 100 is inserted in from the interface 2024 of the female connector 200, the flat board 2015 is inserted into the male mating portion 102, then the electrical terminal 203 electrically connects with the corresponding male terminal 105. The male metallic shell 103 contacts with the female metallic shell 202, the contact portion 2044 of the indicate terminal 204 presses against the outside of the male metallic shell 103, then a circuit is formed between the indication circuit and the grounding circuit, so a LED (Light Emitting Diode) in the indication circuit is turned on to give an indication that the male connector 100 is engaged with the female connector 200 properly.

In a word, when the male connector 100 is engaged with the female connector 200, a circuit is formed between the indication circuit connecting with the indication terminal 204 and the grounding circuit connecting with the grounding portion by the male metallic shell 103 simultaneously contacting with the female metallic shell 202 and the indicate terminal 204, which can give an indication that the male connector 100 is engaged with the female connector 200 properly.

What is claimed is:

1. A HDMI connector assembly, comprising:

a male connector, the male connector having a male housing, a male mating portion extending from the male housing, male terminals received in the male mating portion, and a male metallic shell covering the mating portion; and a female connector having a female housing, having a front surface and a back surface, the female housing defining first passageways and a second passageway communicating with the front surface and the back surface, the second passageway being at the outside of the first passageways, a flat board projecting outwardly from the front surface and inserted into the male mating portion, the flat board defining guide channels communicating with the corresponding first passageways, electrical terminals received in the first passageways and the guide channels for electrically connecting with the male terminals, an indicate terminal having a fixing portion received in the second passageway, the back of the fixing portion forming a welding portion protruding out from the back surface of the female housing for connecting with an indication circuit of a printed circuit board, an elastic arm formed at the front of the fixing portion, the front portion of the elastic arm forming a contact portion, the contact portion at the front of the front surface, and a female metallic shell defining a space for receiving the female housing therein, the front of the female metallic shell defining an interface for the male mating portion inserting, at least one grounding portion protruding from the bottom of the female metallic shell for connecting with a ground circuit of the printed circuit board, wherein the male metallic shell contacts the female metallic shell, the contact portion of the indicate terminal pressing against the outside of the male metallic shell, a circuit formed between the indication circuit and the grounding circuit.

2. The HDMI connector assembly as claimed in claim 1, wherein the back portion of the second passageway defines a second positioning channel through the back surface.

3. The HDMI connector assembly as claimed in claim 1, wherein the fixing portion is L-shaped, which includes a level portion extending forward and an upright portion extending downward, the back of the upright portion extends downward and then backward to form the welding portion, the front end of the fixing portion extends and bends outward to form a bending portion, the elastic arm extends forward from the outer end of the bending portion, the front portion of the elastic arm bends inward and then outward to form the contact portion.

* * * * *